United States Patent [19]

Tashiro

[11] 4,163,175

[45] Jul. 31, 1979

[54] MAGNETRON FOR WHICH LEAKAGE OF H.F. NOISE IS MINIMIZED

[75] Inventor: Norio Tashiro, Yokohama, Japan

[73] Assignee: Tokyo Shibaura Electric Co., Ltd., Kanagawa, Japan

[21] Appl. No.: 871,644

[22] Filed: Jan. 23, 1978

[30] Foreign Application Priority Data

| | | | |
|---|---|---|---|
| Jan. 21, 1977 | [JP] | Japan | 52-5479 |
| Nov. 4, 1977 | [JP] | Japan | 52-148002[U] |
| Nov. 9, 1977 | [JP] | Japan | 52-150126[U] |
| Nov. 11, 1977 | [JP] | Japan | 52-151166[U] |
| Nov. 11, 1977 | [JP] | Japan | 52-151167[U] |

[51] Int. Cl.[2] ..... H01J 25/50

[52] U.S. Cl. ..... 315/39.51; 315/37.75; 315/85; 333/181

[58] Field of Search ..... 315/39.51, 39.75, 39.77, 315/85; 333/79

[56] References Cited

U.S. PATENT DOCUMENTS

| | | | |
|---|---|---|---|
| 3,169,211 | 2/1965 | Drexler et al. | 315/39.51 X |
| 3,727,098 | 4/1973 | Crapuchettes | 315/39.51 |
| 3,732,459 | 5/1973 | Oguro et al. | 315/39.51 |
| 3,846,667 | 11/1974 | Hisada et al. | 315/39.51 |
| 3,916,247 | 10/1975 | Koinuma et al. | 315/39.51 |
| 3,922,612 | 11/1975 | Tashiro | 315/39.51 |
| 3,989,979 | 11/1976 | Konno et al. | 315/39.51 |

*Primary Examiner*—Saxfield Chatmon, Jr.
*Attorney, Agent, or Firm*—Oblon, Fisher, Spivak, McClelland & Maier

[57] ABSTRACT

A high frequency electromagnetic energy absorber disposed near a cathode holder in an evacuated envelope of a magnetron so as to attenuate high frequency noise leaking through the cathode terminal of the magnetron. The absorber is in thermal contact with a member connected to the anode cylinder of the tube to conduct heat generated in the tube, whereby overheating of the tube can be prevented. By combining the absorber with another high frequency attenuating element, the attenuating effect can be increased.

18 Claims, 10 Drawing Figures

MAGNETRON FOR WHICH LEAKAGE OF H.F. NOISE IS MINIMIZED

BACKGROUND OF THE INVENTION

This invention relates to a magnetron and more particularly to a structure of a magnetron which enables it effectively to attenuate at the inside of the tube envelope a high frequency (hereinafter called as h.f.) noise which may leak through the cathode terminal of the tube.

In a magnetron a part of the h.f. electromagnetic energy can leak toward the input terminal of a cathode through a holder which acts to supply a heating power to the cathode.

This h.f. leak is called h.f. noise and its frequency range extends from the KHz to the GHz range. The strongest energy is of course the fundamental wave corresponding to the resonant frequency of the resonant cavity. The h.f. noise not only interferes with other electronic equipment but also is harmful to a human body when its power is strong. To prevent the h.f. leak, a shield box surrounding the cathode input terminal is provided so as to prevent the h.f. energy from leaking out. In the shield box, an LC filter which is composed of an inductor and a capacitor is connected to the cathode lead. However, because the conventional LC filter is connected to the resonant cavities of the magnetron through the cathode input section, both the filter and the cavities interfere with each other or the filter is liable to be burned off. Moreover, requirement about attenuation rate of the filter becomes severe. Further it is impossible to separate the filter section from the magnetron body, as they are unified together. Consequently a degree of freedom about installation of the magnetron in a microwave oven is extremely restricted. It is therefore expected that above-mentioned problems will be solved by utilizing a cathode input section functioning as an h.f. filter. On the other hand a magnetron in which an electromagnetic energy absorber such as a ferrite bead is wound around the cathode holder is well known. But there is the possibility that the ferrite bead can overheat because of the absorption of electromagnetic energy and the receiving of the heat from the cathode and consequently generate a large quantity of gas which is detrimental to the operation of the tube.

SUMMARY OF THE INVENTION

An object of this invention is to provide a magnetron in which leakage of h.f. noise toward a cathode input terminal is minimized.

Another object of this invention is to provide a magnetron preventing h.f. noise from leaking through a cathode holder toward outside of an evacuated envelope by absorbing it in an h.f. absorber at the inside of the evacuated envelope.

Still another object of this invention is to provide a magnetron which operates stably by preventing overheating of an h.f. absorber.

Still another object of this invention is to provide a magnetron which prevents leakage of h.f. noise by using an attenuating means which is set in an evacuated envelope and composed of an h.f. absorber and another attenuating element connected with a cathode holder.

A further object of this invention is to provide a suitable material or a structure of an h.f. absorber and an attenuating element.

A magnetron using this invention comprises an anode cylinder, a cathode, a cathode holder, an evacuated envelope member which constitutes an envelope in cooperation with the anode cylinder, a heat conductor thermally connected with the anode cylinder and an h.f. energy absorber being in contact with the heat conductor and disposed in the vicinity of the cathode holder in the tube. Thus, the h.f. noise transmitted toward the input through the cathode holder is absorbed by the r.f. energy absorber. Moreover as the absorber is thermally connected to the anode cylinder through the heat conductor, overheating of the absorber is prevented. Because the anode cylinder has usually a cooling means which cools the anode cylinder during operation, heat generated in the h.f. absorber is well dispersed to the anode cylinder or the wall of the evacuated envelope whose heat radiation is high.

A magnetron using this invention comprises an h.f. absorber and a reactive or h. f. energy absorbent attenuating element connected to the cathode holder in the evacuated envelope. Thus leakage of r.f. noise can be effectively prevented. The space where the absorber and the attenuating element are disposed is separated from the region in which a plurality of the resonant cavities are defined, so that the output power or oscillating efficiency of the magnetron does not deteriorate.

DETAILED DESCRIPTION OF THE PREFERRED EMBODIMENTS

Figure 1:
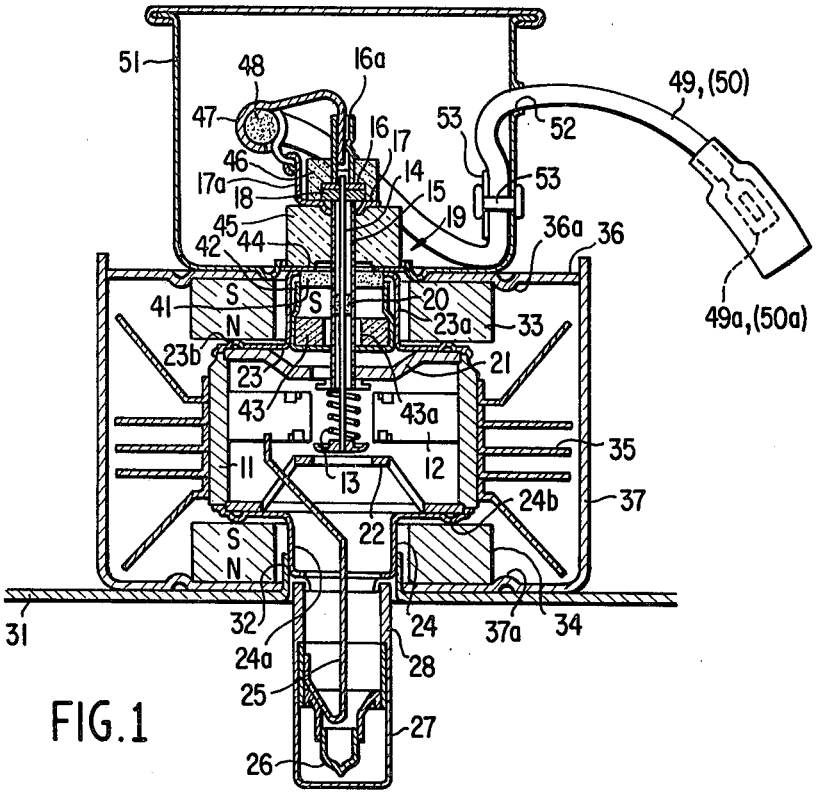
FIG. 1 is a vertical cross-section of one embodiment of the invention.
Figure 2A:
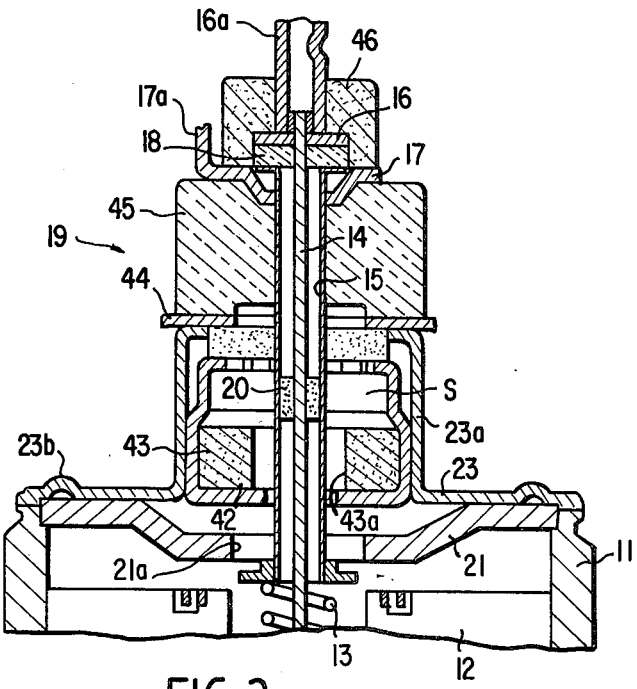
FIG. 2*a* is an enlarged vertical cross-section of the cathode input of the magnetron shown in FIG. 1.
Figure 2B:
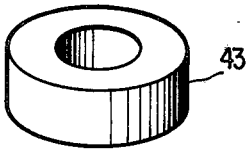
FIG. 2*b* is a perspective view of an h.f. energy absorber.
Figure 2C:
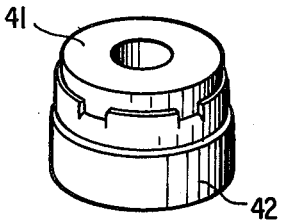
FIG. 2*c* is a perspective view of one embodiment of this invention in which a dielectric member and a holding cylinder are combined.

Referring to the drawings, the structure of the magnetron shown in FIGS. 2*a*, 2*b* and 2*c* is as follows.

In an anode cylinder 11 of copper are secured a plurality of anode vanes 12 defining a plurality of resonant cavities therebetween and is disposed a cathode 13, emitting electrons, on the axis of the anode cylinder. The cathode 13 is supported by a cathode input 19. That is, the cathode 13 is supported at one end by a first rod-shaped cathode holder 14 disposed on the extension of the central axis of the anode cylinder and at the other end by a second tubular cathode holder 15. These cathode holders conduct electric power for heating the cathode. The cathode holders 14, 15 are hermetically sealed at the outer ends with two electrode plates 16, 17 and an insulator 18 such as a ceramic. Between two holders 14 and 15 is interposed a dielectric member 20 of high dielectric constant such as titanium oxide ($TiO_2$). Therefore a capacitance is induced between two cathode holders 14, 15. A pair of magnetic pole pieces 21, 22 are fixed to both ends of the anode cylinder 11. And to the both ends of the anode cylinder 11 are hermetically sealed two thin envelopes 23, 24 of iron respectively. The pole piece 21 is conical and has a through hole 21*a* at its bottom. The other pole piece 22 is a plate having a hole at the center and bent at both ends having notches thereat. Through one of these notches an antenna rod 25 extends from one of the vanes toward the outside of the pole piece 22 and is connected to an exhaust tube 26 and an output cap 27 after extending along the tube axis. At the end of the envelope 24 is hermetically sealed an output antenna insulating cylinder 28. To the side surface of the central cylinder portion 24*a* of the envelope is closely connected the protruded portion 32 of a wall 31 of a waveguide. At both envelopes 23, 24 are respectively provided a plurality of protrusions 23*b*, 24*b* through which two permanent magnets 33, 34 are located. A narrow gap is formed between the envelope and the magnet by the protrusions 23*b*, 24*b*, so that the flow of heat generated at the vanes to the magnet is prevented. On the peripheral surface of the anode cylinder are secured a plurality of radiation fins 35. The outer poles of two magnets 33, 34 are magnetically connected to each other through magnetic yokes 36, 37. On these yokes 36, 37 are provided a plurality of bosses 36*a*, 37*a* defining the setting position of the magnets.

The central cylinder portion 23*a* of the envelope 23 is disposed separately inside the magnet 33. Between the open end and the outer surface of the second tubular cathode holder 15 are interposed a dielectric member 41 of high dielectric constant ($\epsilon r$) (preferably equal to 80~200) such as titanium oxide ($TiO_2$) or strontium titanate ($SrTiO_3$). Between the second cathode holder 15 and the envelope 23 a capacitance is induced through the dielectric member 41. The envelope 23 is electrically connected to the anode cylinder 11 and usually grounded. The dielectric member 20 and 41 are both reactive attenuating elements. Inside of the cylindrical portion 23*a* of the envelope 23 is secured a holding cylinder 42 of stainless steel in which a magnetic h.f. energy absorber 43 of lithium ferrite is supported. The tubular cathode holder 15 is separately located near the inside wall of the through-hole 43*a* of the h.f. energy absorber 43 which is thermally connected to the envelope through the holding cylinder 42. As the envelope 23 is directly exposed to the air and thermally connected to the anode cylinder 11, it functions well as a heat conductor. Therefore the heat generated at the h.f. energy absorber 43 can be well dispersed successively through the holding cylinder 42, the envelope 23, the anode cylinder 11 and the cooling fins 35.

As both the dielectric member 41 and the h.f. energy absorber 43 are made of ceramics, these are reduced in a high temperature hydrogen furnace. As the result, the dielectric property or h.f. energy absorbing property of these members is liable to deteriorate. Consequently it is necessary that these members should be assembled by a method other than soldering which is accompanied with treatment in a high temperature hydrogen furnace. Preferably prior to arc-welding the envelope 23 with the anode cylinder 11, the dielectric member 41 and the h.f. energy absorber 43 are mechanically fixed to the inner surface of the cylinder portion 23*a* of the envelope 23 while keeping thermal contact as mentioned above. Namely the ring-shaped h.f. energy absorber 43 is stuffed into the holding cylinder 42 having a through hole at the bottom through which the cathode holder 15 passes without contact. Subsequently into the opening of the holding cylinder 42 is stuffed the ring-shaped dielectric member 41. The above-mentioned subassembly is disposed at the outer peripheral surface of the cathode holder 15 on which an end hat 13 is to be fixed. The outside diameter of the holding cylinder 42 is slightly larger than the inside diameter of the cylinder portion 23*a* of the envelope. Thus by inserting the holding cylinder 42 toward the upper direction of the drawing, the cylinder 42 is rigidly supported inside the cylinder portion 23*a* of the envelope. In this case the inner surface of the central hole of the dielectric member 41 is in contact with the outer surface of the cathode holder 15 and the outer peripheral surface of the dielectric member 41 is in contact with the holding cylinder 42, the tip of the cylinder portion 23*a* of the envelope and the sealing metal plate 44 being connected to the tip of the cylinder portion 23*a*.

The space (S) where the h.f. energy absorber 43 is placed is substantially isolated from the resonant cavities defined between the anode vanes 12, by means of the pole piece 21 and the bottom of the holding cylinder 42. Accordingly the h.f. energy absorber does not deteriously affect oscillations of the resonant cavities or the radiation efficiency of microwave power from the output antenna. Only h.f. energy entering in the space (S) is effectively absorbed by the absorber. It is desirable that the absorber should be disposed at the place where the h.f. electric field is highest in the space in which it is located.

At the opening of the cylinder portion 23*a* of the envelope is hermetically sealed an insulating cylinder 45 with larger volume through the sealing metal plate 44. The insulator of the insulating cylinder can be a ceramic. At the end of the insulating cylinder is also hermetically sealed an electrode plate 17 of the cathode input 19. A cap 46 of h.f. energy absorbing material such as lithium ferrite having a high Curie point covers two electrode plates 16, 17. The cap 46 absorbs h.f. noise reaching the electrode plates 16, 17. From the electrode plates 16, 17 are taken out respectively two terminals 16*a*, 17*a* to which a bifilar choke coil 47 having a Ni-Zn ferrite core 48 is connected. The choke coil is further connected to an insulated lead wire 49. The cathode input 19 and the choke coil 47 are covered with a shield box 51 which is in contact with the outer peripheral surface of the sealing metal plate 44 electrically connected to the envelope 23. At the side wall of the box 51 are provided two through-holes 52 through which two lead wires 49, 50 fixed to the inside wall of the box by a binding metal 53 and a ribet 54 and having two terminals 49*a*, 50*a* at their ends respectively are taken out.

The magnetron having the above-mentioned structure effectively absorbs h.f. noise entering a space close to the cathode holder inside the evacuated envelope, because the h.f. energy absorber is disposed in this space. The h.f. energy absorber is located in contact with the heat conductor so that heat generated in the absorber disperses rapidly and overheating is prevented. Consequently gas emission from the absorber is well suppressed and the magnetron can operate stably. Moreover when a lithium ferrite is used as an h.f. energy absorber, it is stable during operation of the magnetron because of its high Curie point. Further as the lithium ferrite if magnetic, it exhibits an inductance and the filter effect is enhanced. Besides when the envelope is made of magnetic material, magnetic saturation of the h.f. energy absorber by the magnet is effectively prevented and consequently, its property as an inductor and an absorber to h.f. energy can be kept.

In the evacuated envelope of the magnetron according to this invention are provided two dielectric members as capacitive attenuating members, one of which is interposed between a pair of cathode holders and the other of which is interposed between these cathode holders and an envelope equipotentially connected to an anode cylinder, so that h.f. noise leaking through the cathode holder is bypassed or reflected by the dielectric members. The reflected h.f. noise is re-absorbed by the absorber. As the dielectric members are disposed in the evacuated envelope, it is bearable against high voltage supplies between the cathode and the anode. Furthermore by using titanium ceramics as the dielectric member, high relative dielectric constant ($\epsilon r$) is kept in a temperature range up to 200° C. Consequently the capacitive attenuating property can be kept sufficiently during operation of the magnetron.

Figure 3:
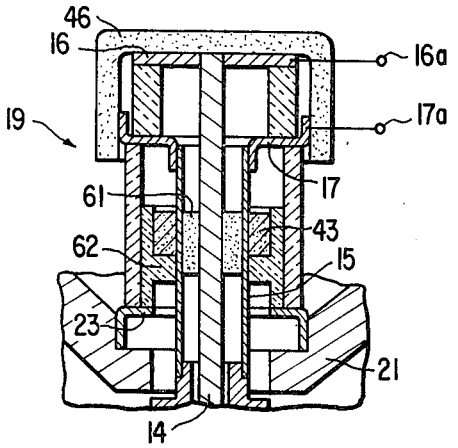
FIG. 3 is a cross-section of the cathode input of one embodiment of this invention.

A magnetron shown in FIG. 3 comprises a first h.f. energy absorber 61 made of manganese ferrite or lithium or the like between two cathode holders 14 and 15 and a second h.f. energy absorber 43 closely disposed on the outer peripheral surface of a tubular cathode holder 15. An absorber 61 is a resistive attenuating element. On the outer peripheral surface of the cathode holder 15 is closely disposed a high heat conductive insulating cylinder 62 such as berrylia ceramics. The insulating cylinder 62 comprises a step-shaped portion to increase the distance along its surface. At the inside end of the cylinder 62 is held the second h.f. energy absorber 43 with thermal contact, and the outside end of the cylinder is in contact with the envelope 23. In consequence two h.f. energy absorbers 61 and 43 are thermally connected to the envelope through the tubular cathode holder 15 acting as a heat conductor, and the insulating cylinder 62, and thereby heat generated in these absorbers is effectively dispersed. The absorber absorbs h.f. noise transmitted through the cathode holders.

Figure 4:
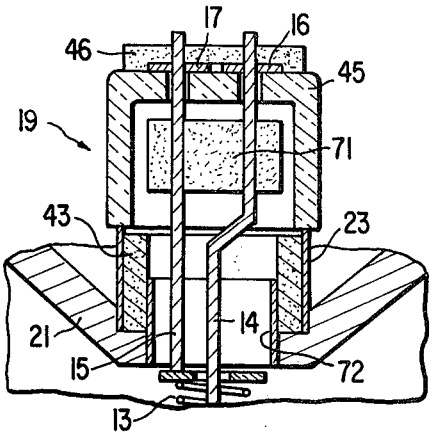
FIG. 4 is a cross-section of the cathode input of another embodiment of this invention.

FIG. 4 shows one embodiment of this invention, in which a cathode stem supporting a cathode 13 with two (or three) rod-shaped cathode holders 14, 15 is utilized. A dielectric ceramic h.f. energy absorber 71 impregnated with carbon is interposed between two holders 14 and 15 so as to short-circuit them. Inside the pole piece (a part of the envelope) electrically connected to the anode cylinder are disposed an h.f. energy absorber 43 of manganese ferrite or lithium ferrite close to the cathode holder. In the absorber 43 a conductive cylinder 72 for a heat shield and an h.f. shield is put in order to prevent temperature raising of the h.f. energy absorber by radiation of heat from the cathode 13 and to isolate the space where the absorbers 71, 43 are placed from the resonant cavities. The magnetron with this structure is able to suppress at the cathode input in the tube any undesired radiation. Especially as the cathode holders are short-circuited by the ceramics member 71 interposed therebetween and impregnated with carbon to have low resistivity and high h.f. energy absorption, h.f. noise can be more effectively suppressed. The dielectric h.f. energy absorber interposed between two cathode holders is a capacitive and absorbent attenuating element. Though its resistivity is relatively small, a low frequency current flowing through the absorber is negligibly small because the voltage for heating the cathode is generally very low as 3 volts. Therefore the resistivity of the absorber may be considerably lowered, whereby the effect of suppressing h.f. leakage can be enhanced.

Figure 6:
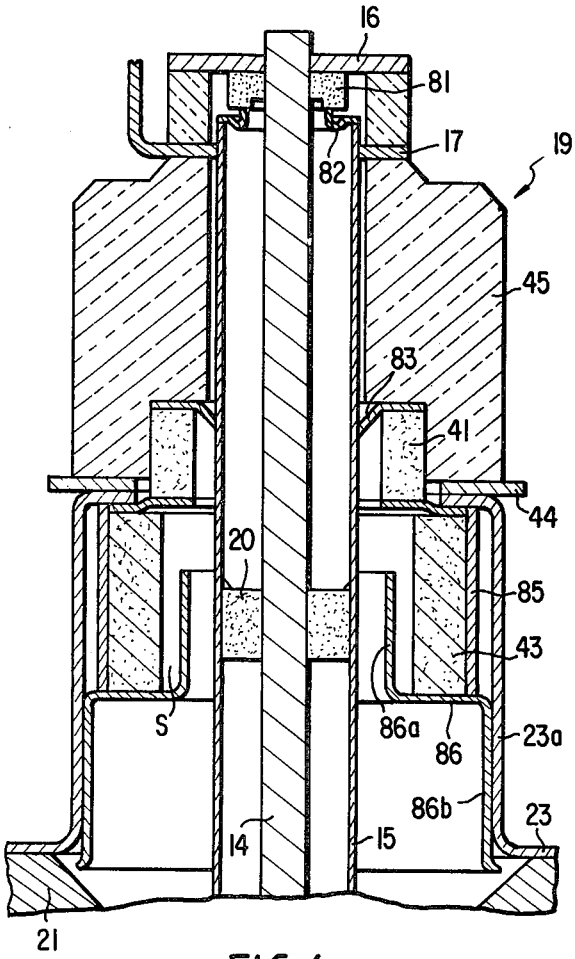
FIG. 6 is an enlarged cross-section of the cathode input shown in FIG. 5.
Figure 5:
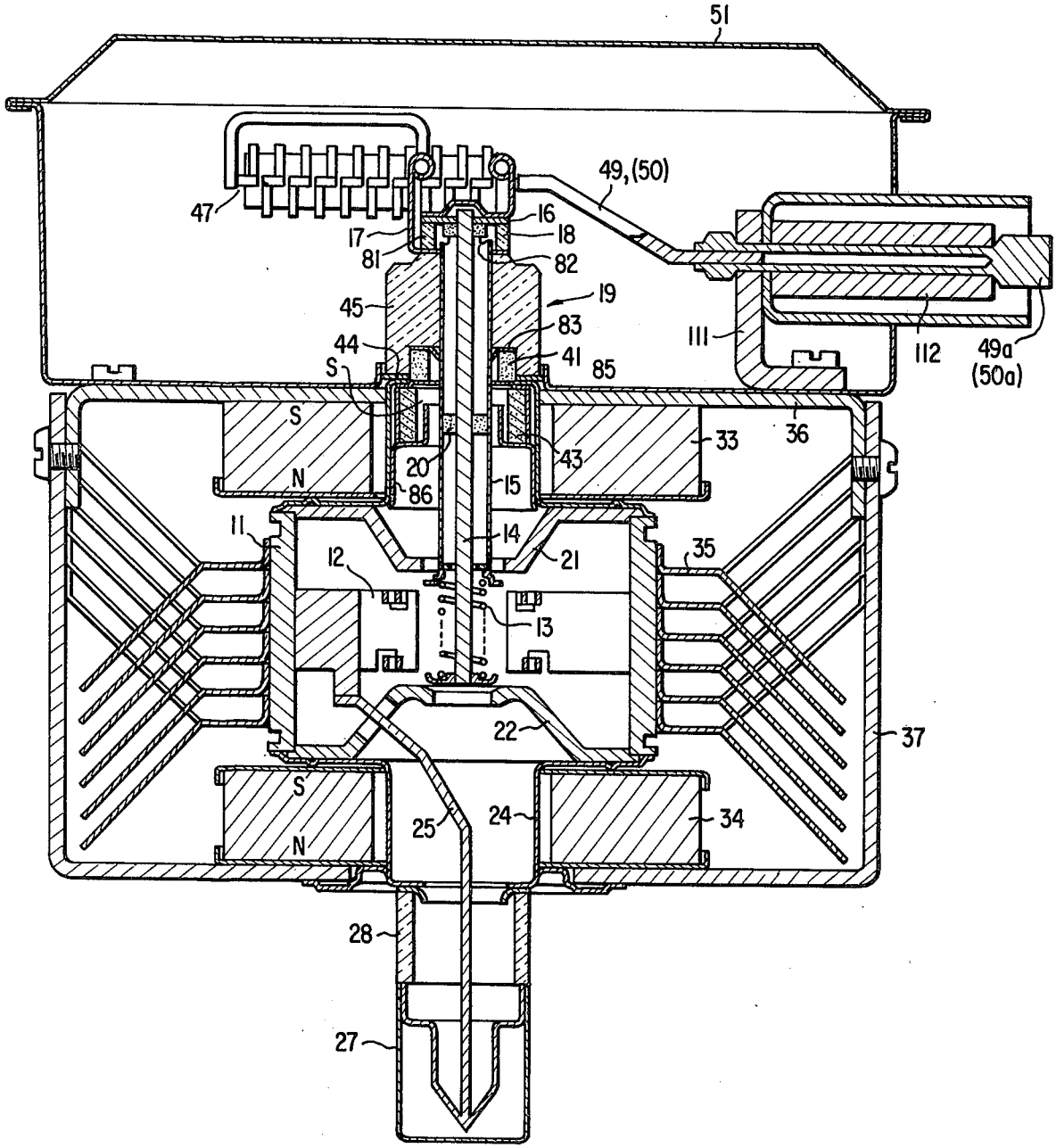
FIG. 5 is a vertical cross-section of the magnetron embodying this invention.

A magnetron shown in FIGS. 5 and 6 has a following structure. Its distinctive cathode input section 19 will be explained according to the assembling process. First, all parts constituting the input section are hermetically soldered in a continuous hydrogen furnace before an end hat, a cathode, an h.f. energy absorber and parts of an attenuation element are assembled. Then a dielectric member 81 made of, for example, strontium titanate ($SrTiO_3$) or calcium titanate ($CaTiO_3$) is inserted from the cathode side. Subsequently a stainless steel disc 82 is inserted. At the periphery of the disc 82 are provided a plurality of petaline portions which narrow when inserted into the inside of the outer cathode holder 15. In these drawings the disc 82 is in contact with the dielectric ring 81 and with the end of the outer cathode holder 15 by its elasticity in axial direction. Thus a capacitance is formed between the outer cathode holder 15 and the inner cathode holder 14. Next a high resilient metal ring 83 made of for example a monel (trade name) metal (Ni-Cu alloy) is secured to the outer peripheral surface of the outer cathode holder 15. After that a ring 41 of dielectric material such as strontium titanate or calcium titanate, a holding disc 84 of stainless steel and a ring-shaped h.f. energy absorber 43 of for example lithium ferrite are successively assembled. A heat conductive ring 85 of copper is fixed to the outside of the absorber 43. Subsequently an iron ring 86 for heat shielding and magnetic shielding is thrust into the cylinder portion **23*a* of the envelope 23. The ring 86 has two cylinder portions 86*a*, 86*b* whose diameters differ from each other and the absorber 43 is upwardly pressed by the shoulder portion thereof. The cylinder portion 86*a* of a smaller diameter is extended along the cathode holder 15 and the cylinder portion 86*b* of a larger diameter is thrust into the cylinder portion 23*a* of the envelope. Thus the absorber 43 is firmly supported. The space (S) is substantially separated from the resonant cavities for h.f. In this drawing as the ring 83 is in contact with the ring 41 and the ring 84 is in contact with ring 43 and with the end of the ring 85, a capacitance is formed between the cathode and the envelope. The dielectric member 20 is interposed between the outer cathode holder 15 and the inner cathode holder 14 before assembling the cathode, and at the following carbonizing process of the cathode in hydrogen atomosphere the surface of the member 20 is slightly reduced to be conductive. The current owing to the above-mentioned conductivity is small because the cathode heating voltage is low. Accordingly this current is negligible as compared with the large heating current. Thus h.f. noise leaking through the cathode holder is prevented. Though the temperature of the dielectric members 81, 40 and 20 is slightly raised, these members keep their dielectric property in the temperature up to 200° C. It is desirable that electrode layers should be formed on mutually facing surfaces of these dielectric members by a metallizing method. The rings 82, 83 have exhausting holes at their peripheries. The cathode leads 49, 50 are supported by a binding insulator 111** and pierce the absorber such as a ferrite bead.

Figure 7:
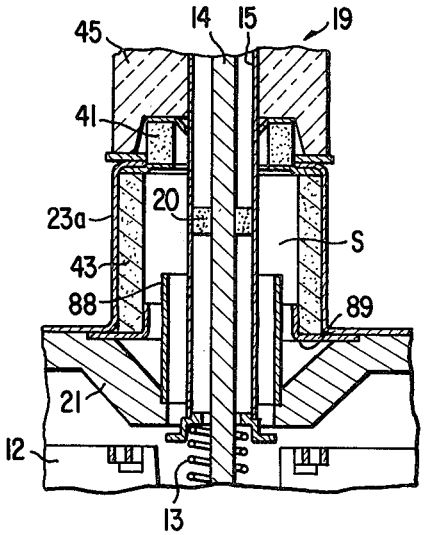
FIG. 7 is a cross-section of the cathode input of another embodiment of this invention.

The magnetron shown in FIG. 7 has a conductive shield cylinder 88 secured to the hole of a pole piece 21. The shield cylinder 88 is extended along and close to the periphery of the cathode holder 15. Thus the space (S) where the absorber 43 is located and the resonant cavities are substantially isolated for h.f. and the heat generated at the cathode does not reach directly the absorber 43. The absorber 43 is closely disposed on the inner wall of the cylinder portion 23*a*, and secured by a support ring 89.

Figure 8:
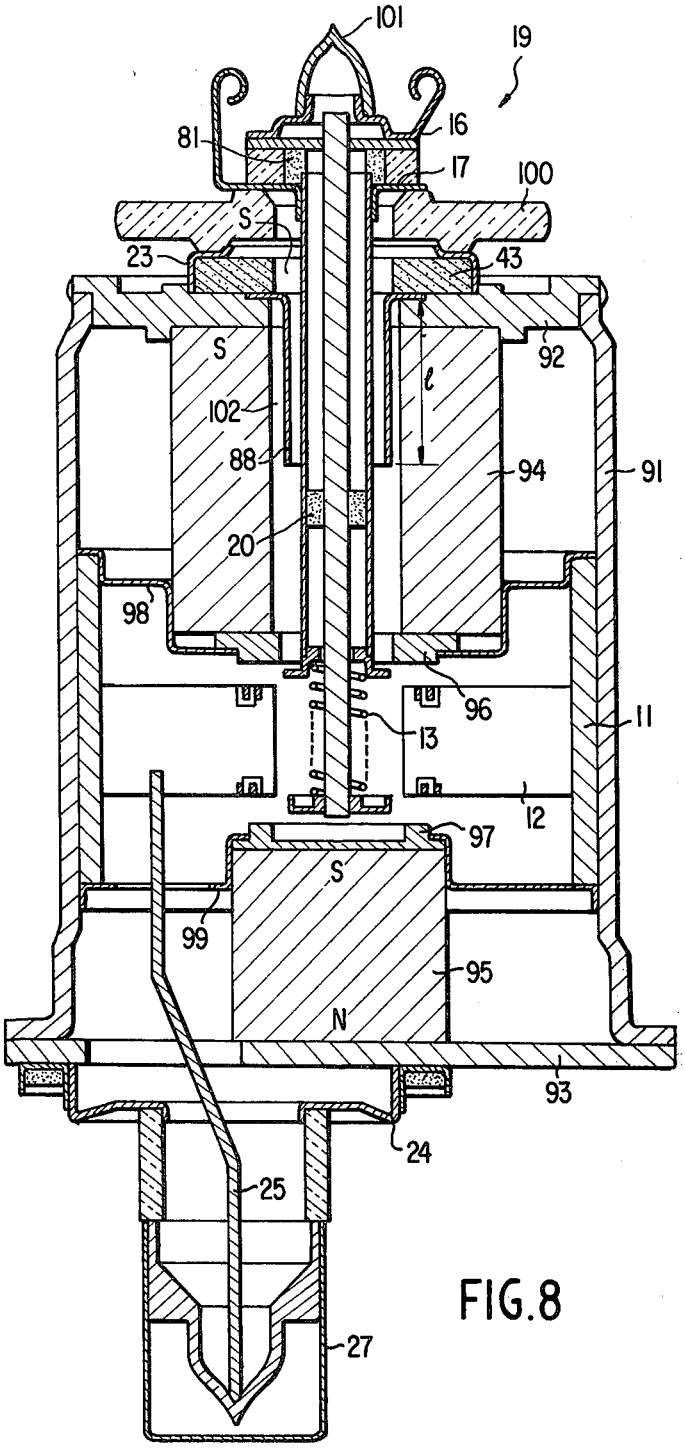
FIG. 8 is a vertical cross-section of the magnetron of still another embodiment of this invention.

The magnetron shown in FIG. 8 comprises two permanent magnets inside the evacuated envelope. In this embodiment, at the inside of magnetic yokes 91, 92 and 93 which constitute the evacuated envelope are disposed an anode cylinder 11, vanes 12, a cylindrical permanent magnet 94, a columnar permanent magnet 95 and pole pieces 96, 97. These magnets and pole pieces are supported by two holders 98, 99 which serve as h.f. shields. The cathode holders 14, 15 pass separately through the central hole of the cylindrical magnet 94 and supported by the cathode input section 19. Preferably these permanent magnets should be made of metallic material such as alnico. The input section 19 comprises an envelope 23 hermetically sealed to the yoke plate 92, a flat insulator 100 and an exhaust tube 101. A ring-shaped h.f. energy absorber 43 is disposed in the space (S) between the yoke end plate 92 and the insulator 101, and fixed thermally in contact with the outer surface of the yoke end plate 92 and the inner surface of the envelope 23. Between the cathode holder 15 and the permanent magnet is located an elongated shield cylinder 88. One end of the cylinder 88 is fixed to the yoke end plate 92 and the other end is extended toward the cathode 13 with its end open. The depth (l) of a groove 102 formed between the cylinder 88 and the inner surface of the conductive permanent magnet is selected to be a quarter of the fundamental wave or any harmonics. Thus the space (S) and the resonant cavities are substantially isolated for h.f. Further at the outer periphery of the yoke cylinder 91 are secured a plurality of radiation fins (not shown). As described above, in this magnetron, any radiation of h.f. noise leaking from the cathode input can be attenuated by the h.f. energy absorber disposed at the cathode input in the envelope or the attenuating element such as a dielectric member or an absorbent dielectric member. Moreover the absorber is never overheated because it is in contact with a heat conducting member.

As an h.f. energy absorber, a ceramics member impregnated with carbon may be used. The dielectric member is not always made of ceramics but may be of dielectric material.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A magnetron comprising:

an anode cylinder having one or more resonant cavities defined therein;

a cathode having an end and located on the axis of the anode cylinder;

a cathode holder supporting the cathode at the end of the cathode and extending in the direction thereof;

magnetic means for providing a magnetic field substantially parallel to the axis in an interaction space defined between the resonant cavities and the cathode and the cathode holder;

an evacuated envelope member hermetically sealed with the anode cylinder and constituting an evacuated envelope in cooperation with the anode cylinder;

a heat conducting member connected thermally to the anode cylinder and located in the vicinity of the cathode holder; and a high-frequency energy absorber located close to the cathode holder in an evacuated area defined by the evacuated envelope and being in contact thermally with the heat conducting member, wherein the high-frequency energy absorber is shielded against a magnetic flux generated from the magnetic means.

2. A magnetron according to claim 6 wherein the high-frequency energy absorber is made of ferrite.

3. A magnetron according to claim 1, wherein the high-frequency energy absorber is made of a material selected from a group consisting of lithium ferrite and manganese ferrite.

4. A magnetron according to claim 1, wherein the high-frequency energy absorber is made of dielectric material.

5. A magnetron according to claim 1, wherein a heat shield is interposed between the cathode and the high-frequency absorber.

6. A magnetron according to claim 1, wherein the high-frequency energy absorber is a ring surrounding the cathode holder.

7. A magnetron according to claim 1, wherein the heat conducting member comprises an insulator with high heat conductivity.

8. A magnetron comprising:

an anode cylinder having one or more resonant cavities defined therein;

a cathode having an end and located on the axis of the anode cylinder;

a cathode holder supporting the cathode at the end of the cathode and extending in the direction thereof;

magnetic means for providing a magnetic field substantially parallel to the axis in an interaction space defined between the resonant cavities and the cathode and the cathode holder;

an evacuated envelope member hermetically sealed with the anode cylinder and constituting an evacuated envelope in cooperation with the anode cylinder;

a heat conducting member connected thermally to the anode cylinder and located in the vicinity of the cathode holder; and a high-frequency energy absorber located close to the cathode holder in an evacuated area defined by the evacuated envelope and being in contact thermally with the heat conducting member, wherein a high-frequency wave shield is provided between the resonant cavities and the space where the high frequency energy absorber is located.

9. A magnetron according to claim 8, wherein the high-frequency wave shield comprises a quarter wave choke.

10. A magnetron according to claim 6 including:

another cathode holder supporting the cathode at the end of the cathode and extending in the direction thereof; and an attenuating element for high-frequency energy connected with the cathode holders in the evacuated area.

11. A magnetron according to claim 10 wherein the attenuating element is made of reactance material.

12. A magnetron according to claim 10, wherein the attenuating element is made of high-frequency energy absorbing material.

13. A magnetron according to claim 10, wherein the attenuating element is disposed between the cathode holders.

14. A magnetron according to claim 11, wherein the attenuating element is disposed between the cathode holders and a member having an equal potential to the anode cylinder.

15. A magnetron according to claim 11, wherein the reactance material is a ferroelectric ceramic.

16. A magentron according to claim 15, wherein the ferroelectric ceramic is selected from the group consisting of titanium oxide, calcium titanate, and strontium titanate.

17. A magnetron according to claim 13, wherein the attenuating element is made of a ceramic with low-frequency conductivity.

18. A magnetron according to claim 10, wherein the high-frequency energy absorber and the attenuating element are closely disposed to each other.

* * * * *